United States Patent [19]

Oberdorf

[11] Patent Number: 4,698,952

[45] Date of Patent: Oct. 13, 1987

[54] APPARATUS FOR FEEDING BLANKS TO A PACKAGING STATION

[75] Inventor: Manfred Oberdorf, Gevelsberg, Fed. Rep. of Germany

[73] Assignee: Maschinenfabrik Alfred Schmermund GmbH, Gevelsberg, Fed. Rep. of Germany

[21] Appl. No.: 872,255

[22] Filed: Jun. 9, 1986

Related U.S. Application Data

[63] Continuation of Ser. No. 635,708, Jul. 30, 1984, abandoned.

[30] Foreign Application Priority Data

Aug. 5, 1983 [DE] Fed. Rep. of Germany ..... 3328322

[51] Int. Cl.[4] ..... B65B 41/02; B65B 19/24

[52] U.S. Cl. ..... 53/456; 53/575; 53/389

[58] Field of Search ..... 53/389, 456, 466, 461, 53/575, 574

[56] References Cited

U.S. PATENT DOCUMENTS

| | | | |
|---|---|---|---|
| 1,792,474 | 2/1931 | Aldrich et al. . | |
| 3,084,491 | 4/1963 | Solomon | 53/389 |
| 3,367,221 | 2/1968 | Schmermund | 53/389 X |
| 4,484,432 | 11/1984 | Oberdorf | 53/575 |
| 4,524,658 | 6/1985 | Foeke et al. | 53/389 X |

FOREIGN PATENT DOCUMENTS

| | | |
|---|---|---|
| 0023982 | 7/1980 | European Pat. Off. . |
| 2362771 | 2/1973 | Fed. Rep. of Germany . |
| 2644173 | 4/1977 | Fed. Rep. of Germany . |
| 2623125 | 8/1977 | Fed. Rep. of Germany . |
| 2065562 | 7/1971 | France . |
| 2204537 | 10/1973 | France . |

*Primary Examiner*—James F. Coan

*Attorney, Agent, or Firm*—Chilton, Alix & Van Kirk

[57] ABSTRACT

Apparatus for feeding package blanks to a package forming machine includes a first conveying system, which moves the blanks at a substantially constant speed while an adhesive is applied thereto, and a second coveying system which receives the moving blanks from the first conveying system and brings their movement to a halt at a point and in an orientation where the blanks are properly positioned to be engaged by a package forming machine. The second conveying system includes an intermittently driven suction belt.

19 Claims, 2 Drawing Figures

APPARATUS FOR FEEDING BLANKS TO A PACKAGING STATION

This is a continuation of application Ser. No. 635,708, filed July 30, 1984, and now abandoned.

BACKGROUND OF THE INVENTION (1) Field of the Invention

The present invention relates to packaging and particularly to the fabrication of packages from pre-formed blanks of packaging material by a process which includes the application of an adhesive followed by folding. More specifically, the present invention is directed to apparatus for conveying pre-formed blanks of packaging material to a packaging station and especially to feeding paper blanks to a folding station via an adhesive applying station. Accordingly, the general objects of the present invention are to provide novel and improved methods and apparatus of such character.

(2) Description of the Prior Art

While not limited thereto in its utility, the present invention is particularly for employment in the packaging of cigarettes, and particularly in combination with so-called "bottom-folding" or "side-folding" packaging machines. In such machines it is known to feed the outer paper blanks, from which the packages will be formed, to a folding station by means of a conveying system comprising cooperating rollers. These rollers are driven at a constant speed and convey the blanks against a stop. An adhesive is applied to the blanks during their movement and, if appropriate, the blanks are also grooved and cut. When the moving blanks contact the stop there is a possibility that they will rebound therefrom, particularly in high-speed packaging equipment, and as a result of such rebounding the blanks may be incorrectly aligned at the time they are engaged by the actual package forming apparatus. While it is possible to provide alignment means for the conveyed package blanks, in order to overcome the problem of inaccurate orientation at the folding station take-over position, to do so requires that the packaging system be increased in complexity and expense and, because of the increased complexity, there is a decrease in reliability.

It is to be noted that, in cellophaning machines, it is known to transport regenerated cellulose film blanks continuously by means of a pair of spacially separated suction belts. In such machines, for example as disclosed in published European patent application No. 0,071,736, the otherwise finished cigarette package or other product being wrapped is periodically pushed between the suction belts. The package engages the regenerated cellulose film and is subsequently urged, together with the film, into a folding turret or a folding. shaft. An adhesive coated paper blank, however, cannot be treated in the same manner as a regenerated cellulose film since this would require that the adhesive coating be applied to the side of the packaging material which faces the suction belts, i.e., the cigarette block could not be pushed through the glue or other adhesive coating so as to be properly supported on the blank. Further, a system which employs a pair of spacially displaced suction belts cannot be adapted for turret-type packaging machines since in such machines the blanks are pushed from turret to turret in an axial direction whereas only a radial pushing movement is possible in cellophaning machines. Also, such pushing action, with the continuously moving blank still being held by suction, would not result in sufficiently accurate orientation of an outer-paper blank from which a soft package is to be formed.

SUMMARY OF THE INVENTION

The present invention overcomes the above-briefly discussed and other deficiencies and disadvantages of the prior art by providing a novel and improved technique, and apparatus for the implementation thereof, which results in the accurate positioning at the entrance to a folding station of packaging material blanks, and particularly soft paper blanks which have been at least partially coated with an adhesive.

Apparatus in accordance with a preferred embodiment of the invention includes a conveying and adhesive-applying station through which the blank will be transported at a constant speed. The adhesive-applying station is followed by a suction belt which is driven intermittently at a speed varying between a maximum, which corresponds to the speed of movement of the blank through the adhesive-applying station, and a momentary stop. The packaging material blank will be engaged by apparatus at the package forming station when its motion has been completely arrested. The reduction in speed of the packaging material blank from the maximum to the momentary stop is accomplished without any abrupt changes in speed which would be likely to result in misalignment of the blank.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE DISCLOSED EMBODIMENT

Figure 2:
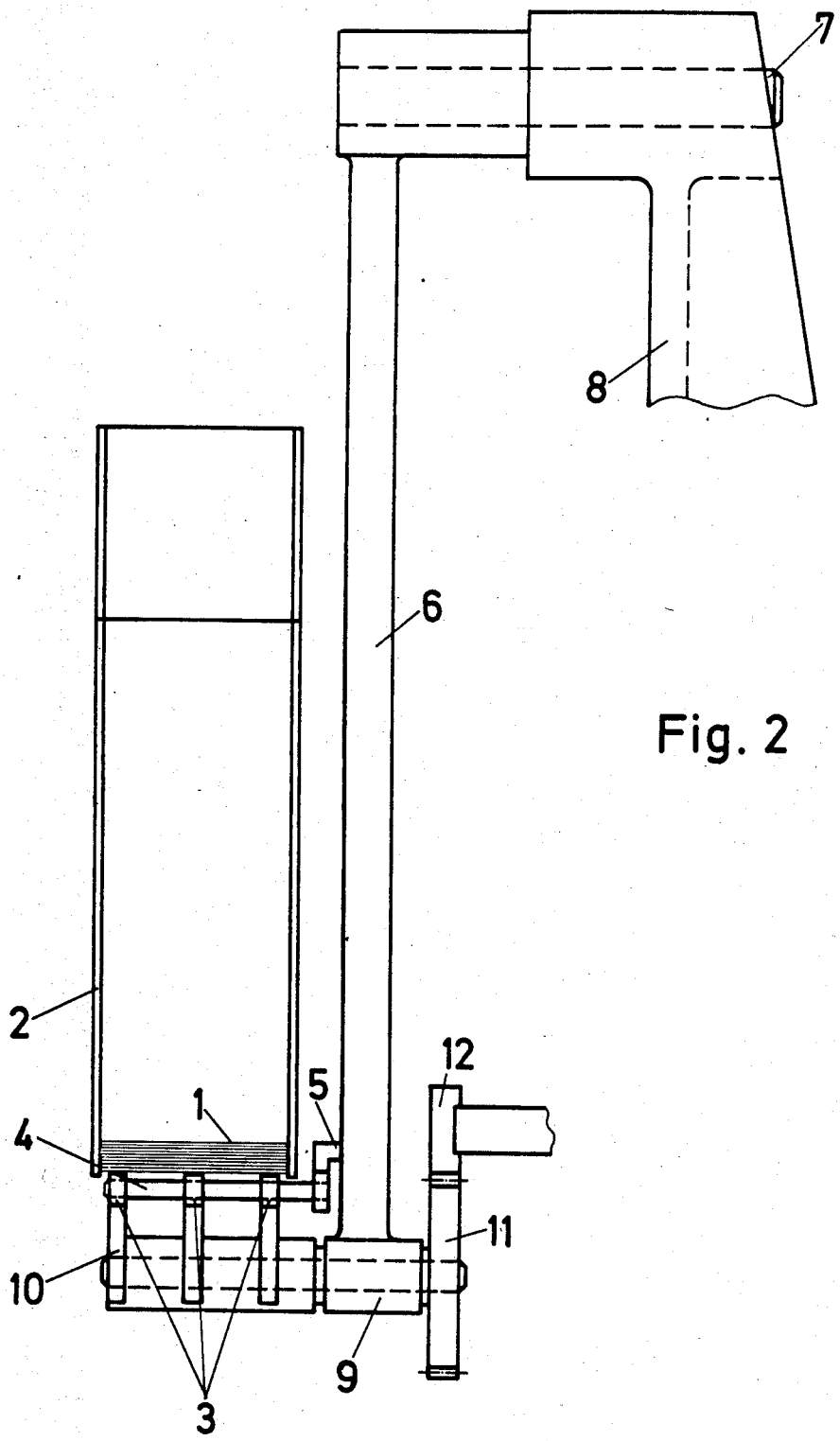
FIG. 2 is a partial front elevation view, taken in the direction of arrow A of FIG. 1, of the apparatus of FIG. 1.

With reference to the drawing, blanks 1 of packaging material are shown as having been stacked in a magazine 2. For purposes of explanation, it may be presumed that the blanks 1 comprise outer-paper blanks from which soft cigarette packages will be formed in an apparatus of the "bottom-folding" type. A "bottom-folding" packaging machine is shown and described in, by way of example only, U.S. Pat. No. 4,484,432. The stack of packaging material blanks 1 in magazine 2 is supported by a plurality of rollers 3. Rollers 3 are mounted on axles 4 as may be seen from FIG. 2. The axles 4 are supported, at first ends thereof, in an angle member 5. The member 5 is connected rigidly to a rocker arm 6 intermediate the ends thereof. The rocker arm 6 is supported, at one end, by an axle 7 which is fastened in a bearing block 8. The opposite or free end of rocker arm 6 supports a shaft 9 on which are mounted a plurality of suction rollers 10 and gearwheel 11. The gearwheel 11 meshes with a toothed segment 12 which is fixed in position. Rocker arm 6 is driven by a crank 13 through a connecting rod 14. The suction rollers 10 are provided with bores 15, first ends of these bores being disposed at the surface of the rollers and the second ends thereof being connected, in a manner not shown, to a vacuum source which may be cycled on and off.

Figure 1:
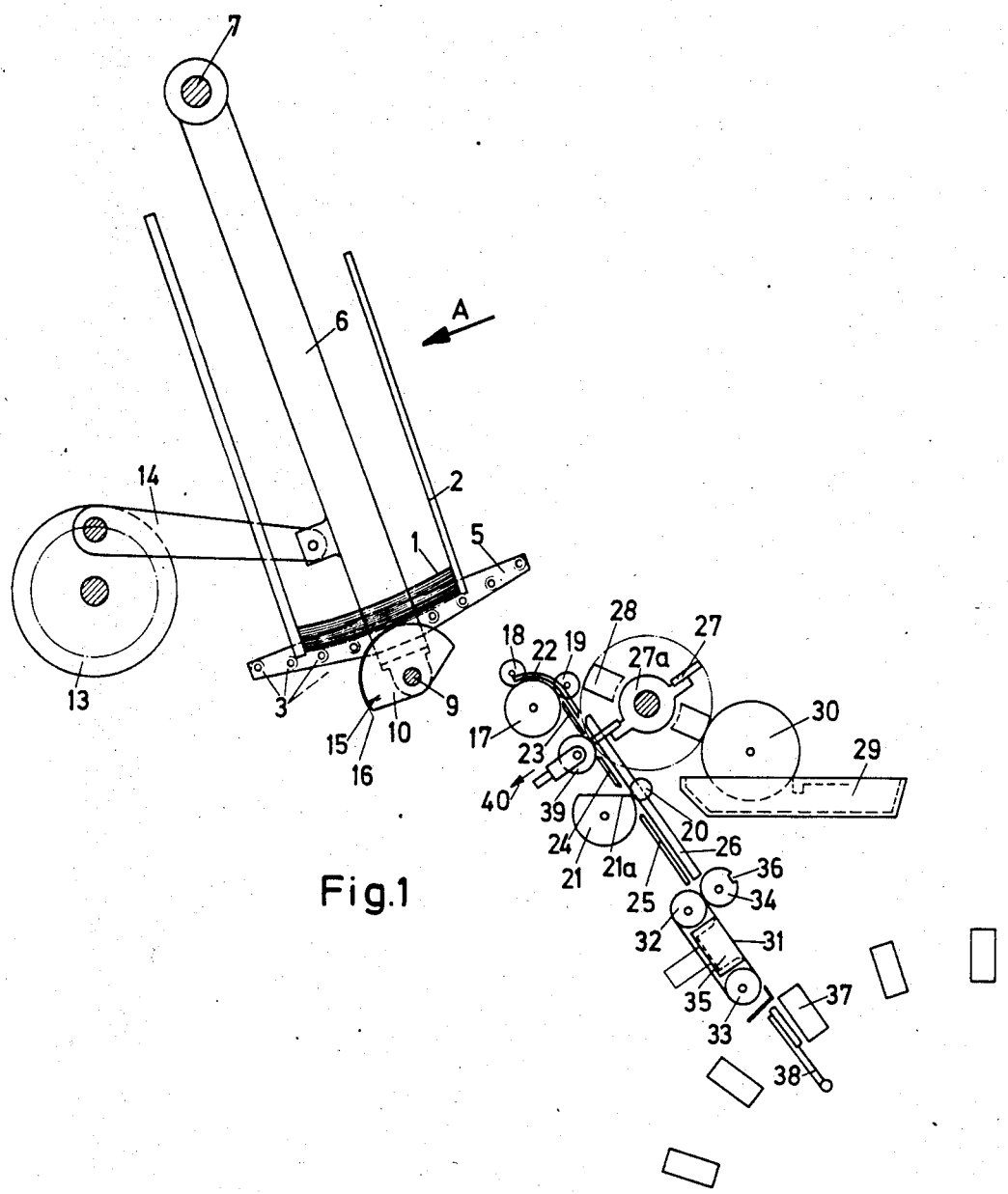
FIG. 1 is a schematic side-elevation view, partly in section, of apparatus for feeding blanks to a packaging station in accordance with the present invention.

When rocker arm 6 is in the pick-up position, which corresponds to its limit of movement to the left as the apparatus is shown in FIG. 1, a blank, indicated at 16 in FIG. 1, will be engaged by the suction rollers. As the rocker arm 6 moves toward its other limit of motion the blank 16 will be rolled out of magazine 2. When the rocker arm reaches its other limit of motion, the vacuum source will be temporarily disconnected from the bores 15 of the suction rollers 10 and the blank 16 will be transferred to a pair of cooperating pick-up rollers 17, 18 of a conveying and adhesive coating station.

The conveying and adhesive-applying station comprises, in addition to the pick-up rollers 17 and 18, further rollers 19, 20 and 21 and guides 22, 23, 24, 25 and 26. The guides are located between the individual rollers as shown in FIG. 1. When the blank 16 has been engaged by rollers 17 and 18, it is guided along the periphery of roller 17 by guide 22 until it is fed between rollers 19 and 17. The blank will thus be transmitted into the space between guides 22 and 23. The guides 22 and 23 terminate in the region of an adhesive-applying roll *27a* which is provided with segments 27 and 28. The segments 27 apply glue in strips oriented transversely to the conveying direction of blanks 16 while segments 28 apply strips of adhesive oriented in the conveying direction of blank 16. The adhesive is supplied from a tray 29 via a transfer roll 30 which is periodically contacted by segments 27 and 28.

After having the adhesive applied thereto, the blank 16 is transported, via rollers 20, 21 and guides 24, 25 and 26, to a conveyor belt 31. It is to be noted that all of rollers 17, 18, 19, 20 and 21 are driven at a constant speed.

Conveyor belt 31 passes over a pair of guide rollers 32, 33 and cooperates, on the infeed side, with a pressure roller or rollers 34. Pressure roller 34 is provided with a recessed surface portion 36 so that the strips of adhesive produced by segments 27 of adhesive applying roll *27a* will not be contacted. Roller 34 is also sized or shaped so that it will not contact the adhesive applied to the blank by segments 28 of roll *27a*. The guide rolls 32 and 33 and the pressure roller 34 are gear driven at a periodically changing speed. The drive results in the speed changing periodically between a momentary stop and a maximum speed at which the speed of belt 31 is equal to the transport speed of the blank 16 through rollers 17–21. This drive can be implemented, for example, by means of a gear-train crank mechanism which has been omitted from the drawing in the interest of facilitating understanding of the invention.

Conveyor belt 31 is perforated and passes over a vacuum source 35. Accordingly, a blank 16 transferred onto belt 31 by rollers 32, 34 will be held on the belt by the applied vacuum and transported safely and without the applied adhesive coating being impaired. When the speed of conveyor belt 31 is equal to the speed imparted to blank 16 by transport roller 17–21, the leading edge of blank 16 is "engaged" by conveyor belt 31 and pressure roller 34. Simultaneously, the trailing edge of blank 16 is released by transport roller 21, roller 21 having a flat surface portion *21a* which periodically "falls" out of engagement with a moving blank. Accordingly, the reduction in speed of belt 31 and a blank 16 conveyed thereon to a momentary stop is not impaired by the constant speed drive of transport rollers 20, 21. The belt 31 will be momentarily stopped when the blank 16 is located between a cell 37 of a turret, not shown, of a bottom-folding packaging machine and a pressing device 38 which forms part of the packaging machine. The pressing device 38, which will typically be actuated by a cam drive, will engage the uncoated side of the blank, thus retaining the blank as movement of the conveyor belt 31 resumes. If necessary or desirable, the operation of vacuum source 35 may be interrupted when conveyor belt 31 is momentarily stopped.

The folding and packaging operations which are performed subsequent to engagement of the blank 16 by the pressing device 38 are carried out in a known manner and will not be described herein.

Should there be no cigarette block or other article available for packaging, the adhesive-coating facility can be The system includes a roller 39 which normally serves as an abuttment for the adhesive-applying roll *27a*. The roller 39 can be retracted or pivoted away in the direction of arrow 40 to avoid being soiled by the adhesive. Ro11er 39 can be moved away from the abuttment position in which it is shown by an appropriately controlled electromagnetic, for example, which acts a9ainst the bias of pressure springs when energized.

It will be understood by those skilled in the art that, rather than being extracted from magazine 2, the blanks 16 can be severed from a roll and transferred to the conveying and adhesive-application station.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for feeding package blanks to a packaging station of a cigarette packaging machine, the cigarette packaging machine being provided with tubular cells for receiving pre-formed blocks of cigarettes, the cells being moved in step-wise fashion along a predetermined path, the package blanks being folded around the cells for packaging the blocks, said feeding apparatus comprising:

means for supplying package blanks;

first conveyor means, said first conveyor means operating at a substantially constant speed and defining a path for movement of package blanks;

means for serially delivering package blanks from said supplying means to said first conveying means whereby said blanks will be transported along said path defined by said first convey or means at said substantially constant speed;

means for applying an adhesive to the moving blanks as they are transported by said first conveyor means;

second conveyor means, said second conveyor means serially receiving the blanks from said first conveyor means, said second conveyor means transporting said received blanks along a linear path from said first conveyor means to a discharge end of said second conveyor means at a speed which decreases smoothly from said constant speed to a stop, said second conveyor means including a gas permeable conveyor belt and a low pressure source which cooperates therewith whereby the blanks are held against said belt by suction, the movement of said second conveyor means being synchronized with the movement of the cells; and retaining means, the blanks being transferred from said second conveyor means discharge end to said retaining means when the motion thereof has been fully arrested, said retaining means applying a blank transferred thereto to a cell of the cigarette packaging machine.

2. The apparatus of claim 1 wherein the adhesive is applied to the moving blanks at least in the form of a strip which is oriented transversely with respect to the direction of motion of the blanks and wherein said second conveying means further comprises:

a blank engaging pressure roll located upstream in the direction of blank travel from said conveyor belt, said pressure roller being provided with a recess in the surface thereof commensurate in size and shape with the said transverse strip of adhesive whereby said pressure roller will not contact the adhesive coating applied to the blank.

3. The apparatus of claim 1 wherein said means for applying adhesive comprises:

an adhesive transfer roll; and a retractable abuttment roller positioned at the opposite side of a moving blank from the point of contact of said transfer roll with the blanks.

4. The apparatus of claim 2 wherein said means for applying adhesive comprises:

an adhesive transfer roll; and a retractable abuttment roller positioned at the opposite side of a moving blank from the point of contact of said transfer roll with the blanks.

5. The apparatus of claim 1 wherein said first conveying means includes a final transport roller positioned downstream of said adhesive applying means, said final transport roller having a flattened surface portion whereby blanks transported by said first conveying means are periodically released by said final roller, said release corresponding with the time of engagement of the blank by said second conveying means.

6. The apparatus of claim 2 wherein said first conveying means includes a final transport roller positioned downstream of said adhesive applying means, said final transport roller having a flattened surface portion whereby blanks transported by said first conveying means are periodically released by said final roller, said release corresponding with the time of engagement of the blank by said second conveying means.

7. The apparatus of claim 3 wherein said first conveying means includes a final transport roller positioned downstream of said adhesive applying means, said final transport roller having a flattened surface portion whereby blanks transported by said first conveying means are periodically released by said final roller, said release corresponding with the time of engagement of the blank by said second conveying means.

8. The apparatus of claim 4 wherein said first conveying means includes a final transport roller positioned downstream of said adhesive applying means, said final transport roller having a flattened surface portion whereby blanks transported by said first conveying means are periodically released by said final roller, said release corresponding with the time of engagement of the blank by said second conveying means.

9. The apparatus of claim 1 wherein the package blanks are stored in said supplying means in the form of a stack and wherein said delivering means comprises:

movable suction means for periodically engaging and removing individual blanks from the bottom of said stack in said supplying means;

rocker arm means for imparting movement to said suction means to cause said suction means to withdraw blanks from said stack and deliver said withdrawn blanks to said first conveyor means.

10. The apparatus of claim 9 wherein said supply means comprises:

means for supporting a stack of package blanks, said supporting means comprising a plurality of rollers.

11. The apparatus of claim 10 wherein said rocker arm means includes:

a crank drive means for imparting motion to said rocker arm means.

12. The apparatus of claim 9 wherein the adhesive is applied to the moving blanks at least in the form of a strip which is oriented transversely with respect to the direction of motion of the blanks and wherein said second conveying means further comprises:

a blank engaging pressure roll located upstream in the direction of blank travel from said conveyor belt, said pressure roller being provided with a recess in the surface thereof commensurate in size and shape with the said transverse strip of adhesive whereby said pressure roller will not contact the adhesive coating applied to the blank.

13. The apparatus of claim 12 wherein said means for applying adhesive comprises:

an adhesive transfer roll; and a retractable abuttment roller positioned at the opposite side of a moving blank from the point of contact of said transfer roll with the blanks.

14. The apparatus of claim 13 wherein said first conveying means includes a final transport roller positioned downstream of said adhesive applying means, said final transport roller having a flattened surface portion whereby blanks transported by said first conveying means are periodically released by said final roller, said release corresponding with the time of engagement of the blank by said second conveying means.

15. The apparatus of claim 14 wherein said supplying means comprises:

a magazine for receiving a stack of blanks; and means for supporting said stack of blanks in said magazine, said supporting mens comprising a plurality of spaced-apart rollers.

16. The apparatus of claim 15 wherein said rocker arm means includes:

a crank drive means for imparting motion to said rocker arm means.

17. In a process for the packaging of cigarettes, the cigarettes being formed into block-shaped groups which are thereafter disposed in carriers and a package blank being subsequently wrapped around each carrier, an improved method for the delivery of package blanks from a storage magazine to the carriers for subsequent wrapping comprising the steps of:

withdrawing individual package blanks from a storage magazine;

serially transporting the withdrawn blanks at a constant speed along a predetermined path;

applying a coating of an adhesive to a portion of each blank as it moves at the constant speed along said path;

pneumatically capturing the partly coated blanks;

smoothly decreasing the speed of movement of the captured blanks from said constant speed until the motion of the blanks has been fully arrested;

releasing the captured blanks when the speed thereof has been fully arrested; and transferring the released blanks into registration with the carriers.

18. The method of claim 17 wherein the step of withdrawing comprises:

periodically engaging and removing individual blanks from the bottom of a stack of blanks disposed in a storage magazine; and conveying the removed blanks along a nonlinear path to the beginning of said predetermined path.

19. The method of claim 18 wherein said predetermined path is linear and wherein the step of decreasing the speed movement is performed along an extension of said linear path.

* * * * *